US009033053B2

(12) United States Patent
Borsheim

(10) Patent No.: US 9,033,053 B2
(45) Date of Patent: May 19, 2015

(54) METHOD AND DEVICE FOR EXTENDING LIFETIME OF A WELLHEAD

(71) Applicant: Subsea Solutions AS, Sandnes (NO)

(72) Inventor: Torfinn Borsheim, Sandnes (NO)

(73) Assignee: Subsea Solutions AS, Sandnes (NO)

( * ) Notice: Subject to any disclaimer, the term of this patent is extended or adjusted under 35 U.S.C. 154(b) by 0 days.

(21) Appl. No.: 14/352,198

(22) PCT Filed: Oct. 25, 2012

(86) PCT No.: PCT/NO2012/050208
§ 371 (c)(1),
(2) Date: Apr. 16, 2014

(87) PCT Pub. No.: WO2013/062421
PCT Pub. Date: May 2, 2013

(65) Prior Publication Data

US 2014/0246202 A1 Sep. 4, 2014

(30) Foreign Application Priority Data

Oct. 27, 2011 (NO) ..... 20111456

(51) Int. Cl.
*E21B 34/04* (2006.01)
*E21B 33/035* (2006.01)
*E21B 33/037* (2006.01)

(52) U.S. Cl.
CPC ..... *E21B 34/045* (2013.01); *E21B 33/0375* (2013.01); *E21B 33/0355* (2013.01)

(58) Field of Classification Search
USPC ..... 166/368, 335, 351, 360, 65.1
See application file for complete search history.

(56) References Cited

U.S. PATENT DOCUMENTS 3,142,337 A * 7/1964 Poorman, Jr. et al. ..... 166/338
3,894,560 A * 7/1975 Baugh ..... 137/606

(Continued)

FOREIGN PATENT DOCUMENTS

NO 20110764 1/2012
WO WO 8203887 A1 * 11/1982 ..... E21B 34/04

OTHER PUBLICATIONS

International Search Report for PCT/NO2012/050208, dated Jan. 18, 2013.

(Continued)

*Primary Examiner* — James G Sayre
(74) *Attorney, Agent, or Firm* — Andrus Intellectual Property Law, LLP

(57) ABSTRACT

A method and a device are for extending the lifetime of a Christmas tree. The Christmas tree is provided with at least a first high-pressure hydraulic valve pack, a first low-pressure hydraulic valve pack or a first chemical valve pack, and the Christmas tree is arranged to be connectable to an umbilical, which comprises at least electrical power or control cables, hydraulic tubes or chemical tubes. The method comprises:

retrofitting an upgrading module to or by the Christmas tree and connecting the upgrading module to the Christmas tree with the necessary number of tube and wire connections, the upgrading module comprising a second control module, and at least a hydraulic high-pressure pump with a second high-pressure valve pack and a hydraulic reservoir, a hydraulic low-pressure pump with a second low-pressure hydraulic valve pack and a hydraulic reservoir or a chemical pump with a chemical reservoir;

supplying the second control module with electrical power and control signals via the umbilical or from vessel; and supplying at least the high-pressure pump, the low-pressure pump or the chemical pump, directly or indirectly via their respective reservoirs, with hydraulic fluid via the umbilical or from a vessel.

7 Claims, 3 Drawing Sheets

(56) References Cited

U.S. PATENT DOCUMENTS

| | | | | | |
|---|---|---|---|---|---|
| 4,112,687 | A | * | 9/1978 | Dixon | 60/641.6 |
| 4,174,000 | A | | 11/1979 | Milberger | |
| 4,337,829 | A | * | 7/1982 | Banzoli et al. | 166/366 |
| 4,407,183 | A | * | 10/1983 | Milberger et al. | 91/1 |
| 4,497,369 | A | * | 2/1985 | Hurta et al. | 166/368 |
| 5,166,677 | A | * | 11/1992 | Schoenberg | 340/853.3 |
| 6,298,767 | B1 | * | 10/2001 | Porter | 91/4 R |
| 2005/0178560 | A1 | | 8/2005 | Johansen et al. | |
| 2008/0302536 | A1 | | 12/2008 | Kotrla et al. | |

OTHER PUBLICATIONS

Written Opinion for PCT/NO2012/050208, dated Jan. 19, 2013.

* cited by examiner

METHOD AND DEVICE FOR EXTENDING LIFETIME OF A WELLHEAD

CROSS-REFERENCE TO RELATED APPLICATIONS

This application is U.S. national stage application of International Application PCT/NO2012/050208, filed Oct. 25, 2012, which international application was published on May 2, 2013, as International Publication WO2013/062421 in the English language. The international application is incorporated herein by reference, in entirety. The international application claims priority to Norwegian Patent Application No. 20111456, which is incorporated herein by reference.

FIELD

This invention relates to a method of extending the lifetime of a Christmas tree. More particularly, it relates to a method of extending the lifetime of a Christmas tree, the Christmas tree being provided with at least a first high-pressure hydraulic valve pack, a first low-pressure hydraulic valve pack or a first chemical valve pack, and the Christmas tree being arranged to be connectable to an umbilical comprising at least electrical power or control cables, hydraulic tubes or chemical tubes. The invention also comprises a device for practising the method.

BACKGROUND

While recovering petroleum offshore it has turned out that there is a need to exceed the technical and economic lifetime originally intended for well equipment. This holds true also of safety-critical components such as a Christmas tree with associated valves and control apparatuses.

A Christmas tree located on the seabed has often been guided onto a production tubing head via guide posts. The Christmas tree communicates with equipment on the surface via a so-called umbilical which may typically comprise cables for electrical power and signals, optical fibres for signal transmission, tubes for hydraulic fluid under high pressure and low pressure and also tubes for the supply of chemicals. It is common for the. Christmas tree to be provided with a valve jacket which constitutes a barrier between the annulus, the production passage and the surroundings. The valve jacket must be removed when a suitable tool provided with connections for fluids that are used for removing deposits and also for well-killing is to be fitted.

The terms high pressure and low pressure are not exact, as they vary between the different suppliers. Roughly, a pressure between 100 and 300 bars is termed low pressure whereas a pressure above 300 bars is termed high pressure. By pressures below 100 bars, actuators and valves may take a so-called "fail safe" position which will often shut down the petroleum production.

The hydraulic fluids are typically carried to, respectively, a high-pressure and a low-pressure valve pack on the Christmas tree, the high-pressure valve pack communicating with a downhole blowout preventer, whereas the low-pressure valve pack communicates with, among other things, a number of actuators mainly for valve control in the Christmas tree.

Electrical power and control signals are conveyed to a submerged control module on or by the Christmas tree. The control module which is controlled from the surface is connected to the different hydraulic valves of the valve packs and thereby controls the different valve functions in the Christmas tree.

Known Christmas-tree installations exhibit several weaknesses that emerge after a long operating time. The control module is prone to functional faults while, at the same time, the availability of new control modules of the kind in question and also spare parts therefor is limited. Valve leakages do occur in the so-called production-swab valve (PSV) of the Christmas-tree jacket. The monitoring here is often insufficient. Leaks into the annulus between the well and the Christmas tree do occur as well. Further, it has turned out that pressure sensors are prone to faulty functioning.

The umbilical with associated components is prone to leakages.

Considerable delays in deliveries of umbilicals and associated operations do occur as well, leading to delayed production start for the relevant Christmas tree.

SUMMARY

The invention has for its object to remedy or reduce at least one of the drawbacks of the prior art.

The object is achieved according to the invention through the features which are specified in the description below and in the claims that follow.

In a first aspect of the invention, a method of extending the lifetime of a Christmas tree is provided, the Christmas tree being provided with at least a first high-pressure hydraulic valve pack, a first low-pressure hydraulic valve pack or a first chemical valve pack, and the Christmas tree being arranged to be connectable to an umbilical which comprises at least electrical power or control cables, hydraulic tubes or chemical tubes, and the method being characterized by comprising:

- retrofitting an upgrading module to or by the Christmas tree and connecting the upgrading module to the Christmas tree with the necessary number of tube and wire connections, the upgrading module comprising a second control module, and at least a hydraulic high-pressure pump with a second high-pressure hydraulic valve pack and a hydraulic reservoir, a hydraulic low-pressure pump with a second low-pressure hydraulic valve pack and a hydraulic reservoir or a chemical pump with a chemical reservoir;
- supplying the second control module with electrical power and control signals via the umbilical or from a vessel; and
- supplying at least the high-pressure pump, the low-pressure pump or the chemical pump directly or via their respective reservoirs with hydraulic fluid via the umbilical or from a vessel.

By connecting the upgrading module to the Christmas tree in the desired way, the control operations in the Christmas tree may be taken over, to the extent necessary, by the second control module. Further, hydraulic functions and chemical dosing may be taken over by the upgrading module to the extent necessary.

The second control module which, besides being able to control pumps and valve packs in the upgrading module, is arranged to control the desired functions in the Christmas tree as well, may be supplied with power and control signals via the umbilical, or, if the umbilical is damaged or before it arrives, from a vessel on the surface, possibly via a second Christmas tree located in the vicinity or an upgrading module. In the case of an older Christmas tree, it may be relevant to connect the second control module to the first control module, in particular to collect measurement signals from sensors in the Christmas tree or to connect new sensors from a pipeline.

Hydraulic fluid to the hydraulic pumps and chemicals to the chemical pump may be supplied via tubes available in the umbilical, or, if the umbilical is damaged or not present, from a vessel. The high-pressure pump may be supplied with hydraulic fluid from a low-pressure tube or some other tube in the umbilical, for example.

The method may comprise providing the upgrading module with a valve jacket and placing the upgrading module on the Christmas tree after a separate valve jacket has been removed. It is thereby possible to measure the pressure in the annulus and the pressure between the Christmas tree and the upgrading module by means of the second control module.

According to a second aspect of the invention, an upgrading module is provided for retrofitting to or by a Christmas tree, the Christmas tree being provided with at least a first high-pressure hydraulic valve pack, a first low-pressure hydraulic valve pack or a first chemical valve pack, and the Christmas tree being arranged to be connectable to an umbilical which comprises at least electrical power or control cables, hydraulic tubes or chemical tubes, and the upgrading module being characterized by being provided with an electric second control module which is connectable to the power and control lines of an umbilical or to some other supply, and the upgrading module comprising at least a hydraulic high-pressure pump with a second high-pressure hydraulic valve pack and a hydraulic reservoir, a hydraulic low-pressure pump with a second low-pressure hydraulic valve pack and a hydraulic reservoir or a chemical pump with a chemical reservoir, the upgrading module being connectable to the Christmas tree.

The hydraulic high-pressure pump may be connectable, directly or indirectly via a reservoir, to at least the tubes of an umbilical or to a vessel and to at least a valve of a second high-pressure hydraulic valve pack and to the second control module.

The hydraulic low-pressure pump may be connectable, directly or indirectly via a reservoir, to at least the tubes of an umbilical or to a vessel and to at least a valve of a second low-pressure hydraulic valve pack and to the second control module.

The chemical pump may be connectable, directly or indirectly via a reservoir, to at least the tubes of an umbilical or to a vessel, and to at least a chemical valve or directly to a production tubing.

The second control module is connected to a valve pack for chemical injection.

The upgrading module may be connected to the Christmas tree by means of ROV-activatable connections. Examples of such connections are so-called MQC plates and Tronic connectors.

The components of the upgrading module may be arranged as dual systems with a main system and a back-up system to guarantee operation if a component should fail. The high-pressure pump and associated components may be replaced by a pressure booster which is supplied with fluid from a low-pressure system, for example.

It is also possible to connect several Christmas trees to upgrading modules belonging to different Christmas trees, for example if the umbilical belonging to one of the Christmas trees should suffer substantial damage, or to increase the reliability of the Christmas trees in an entire area.

The invention enables the use of a simpler umbilical which is better suited for use in hilly terrain, it thereby being easier to protect the umbilical against damage, for example from fishing vessels.

The method and the device according to the invention solve weaknesses of existing control modules for Christmas trees, while, at the same time, the fluid pressure in existing umbilicals maybe reduced considerably. It is also possible to make use of other tube passages in the umbilical for the supply of hydraulic fluid if a tube passage should become unusable. By the use of a reservoir in the upgrading module, the same tube passage of the umbilical may be used for both the supply and the return of fluid. It is further possible to use temporary supply for all functions from a vessel.

In what follows, an example of a preferred method and embodiment is described, which is visualized in the accompanying drawings, in which:

DETAILED DESCRIPTION OF THE DRAWINGS

Figure 1:
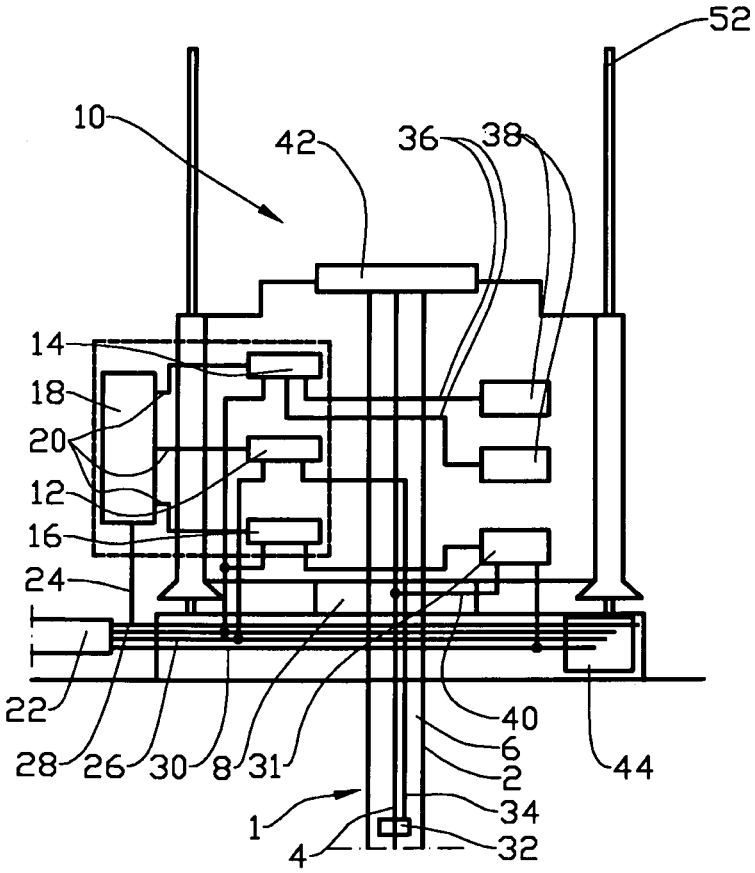
FIG. 1 shows schematically a Submerged well with a prior-art Christmas tree.

In the drawings, the reference numeral 1 indicates a subsea well with an outer pipe 2, for example in the form of a casing, and a production tubing 4, wherein an annulus 6 is formed between the outer pipe 2 and the production tubing 4.

The production tubing 4 is hung off in a wellhead 8, a Christmas tree 10 being positioned on the wellhead 8.

The Christmas tree 10 is provided with a high-pressure hydraulic valve pack 12, a low-pressure hydraulic valve pack 14 and a chemical valve pack 16.

The different valve packs 12, 14, 16 are controlled, via control lines 20, from a control module 18 located by or on the Christmas tree 10. The valve packs 12, 14, 16 and the control module 18 are often constituted by an assembly which is indicated in the figures by means of a dotted rectangle.

An umbilical 22 which extends to a plant, not shown, on the surface comprises electrical wires 24 for electrical power and control signals, a high-pressure tube 26, a low-pressure tube 28 and a chemical tube 30.

The electrical wires 24 are connected to the control module 18, the high-pressure tube 26 to the high-pressure hydraulic valve pack 12, the low-pressure tube 28 to the low-pressure hydraulic valve pack 14 and the chemical tube 30 to a chemical valve 31 which is activated by means of the chemical valve pack 16.

The high-pressure hydraulic valve pack 12 is connected to a downhole blowout preventer 32 by means of a blowout-preventer tube 34. The low-pressure hydraulic valve pack 14 is connected by means of actuator tubes 36 to actuators 38 in the Christmas tree. The chemical valve 31 is connected to the production tubing 4 by means of a chemical passage 40.

The Christmas tree 10 is provided with a Christmas-tree jacket 42 and otherwise comprises a large number of components not shown, which are known to a person skilled in the art.

Tubes and wires 24, 26, 28 and 30 in the umbilical 22 are extended in a normal way to a ROV-connectable first panel 44.

Figure 2:
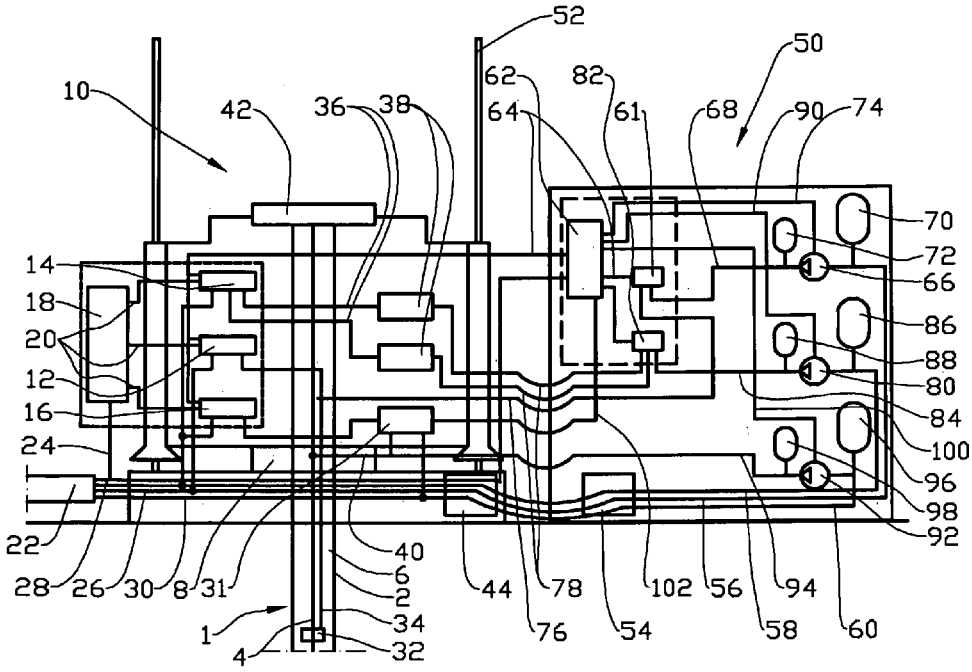
FIG. 2 shows schematically an upgrading module according to the invention, the upgrading module being by the Christmas tree.

Reference is now made to FIG. 2. An upgrading module 50 is placed beside the Christmas tree 10. If desirable, the upgrading module 50 may be placed on the Christmas tree 10, possibly located by means of the guide posts 52 of the well 1.

The upgrading module 50 is provided with an ROV-connectable second panel with connectors 54 which are connected to a high-pressure hydraulic connection 56, a low-pressure hydraulic connection 58 and a chemical connection 60. The other connections 54 are connected, in a manner known per se, to the first connectors 44.

Further, a second high-pressure hydraulic valve pack 61 and a second control module 62 have been arranged, the second control module 62 being connected, in this preferred exemplary embodiment, directly or via the control module 18 to the electrical wires 24 of the umbilical 22, controlling the different valve packs 12, 14, 16 via control lines 64, as the control lines 20 from the control module 18 may be disconnected. Alternatively, the second control module 62 may control the valve packs 61, 82 via control lines 64 if the valve packs 12, 14, 16 are out of function.

A hydraulic high-pressure pump 66 is located in the upgrading module 50 and is supplied with hydraulic fluid at reduced pressure from the high-pressure tube 26 via the high-pressure hydraulic connection 56. The high-pressure-hydraulic valve pack 12 may be disconnected from the high-pressure tube 26. The high-pressure pump 66 is connected to the second high-pressure hydraulic valve pack 61 by means of a high-pressure tube 68. A reservoir 70 is connected to the inlet side of the high-pressure pump 66 while an accumulator 72 is connected to the outlet side of the high-pressure pump 66. The high-pressure pump 66 is controlled from the second control module 62 via a control line 74. The second high-pressure hydraulic valve pack 61 is connected to the blowout-preventer tube 34 by means of a high-pressure tube 76 in the same way as the second low-pressure hydraulic valve pack 82 is connected to the actuators 38 by means of low-pressure tubes 78.

The upgrading module 50 is also provided with a low-pressure pump 80 and is supplied with hydraulic fluid at reduced pressure from the low-pressure tube 28 via the low-pressure hydraulic connection 58. The low-pressure hydraulic valve pack 14 may be disconnected from the low-pressure tube 28. The low-pressure pump 80 is connected to a second low-pressure hydraulic valve pack 82 by means of a low-pressure tube 84. A reservoir 86 is connected to the inlet side of the low-pressure pump 80 while an accumulator 88 is connected to the outlet side of the low-pressure pump 80. The low-pressure pump 80 is controlled from the second control module 62 via a control line 90.

If desirable, the high-pressure pump 66 may also be supplied with hydraulic fluid via the low-pressure tube 28.

A chemical pump 92 is supplied with chemical, possibly at reduced pressure, from the chemical tube 30 via the chemical conduit 60. The chemical valve 31 may be disconnected from the chemical tube 30. The chemical pump 92 is connected to the chemical valve 31 or directly to the production tubing 4 by means of a chemical connection 94. A reservoir 96 is connected to the inlet side of the chemical pump 92 while an accumulator 98 is connected to the outlet side of the chemical pump 92. The chemical pump 92 is controlled from the second control module 62 via a control line 100, whereas the chemical valve 31 is controlled from the second control module 62 via a control line 102.

When the upgrading module 50 is to be installed, it is placed on or by the Christmas tree 10, after which connections, tubes and the wire connections 24, 56, 58, 60, 64, 76 and 78 are connected to the Christmas tree 10 as described above.

The second control module 62 is then controlled in a manner known per se to start the components concerned in the Christmas tree 10 and the upgrading module 50. Which components are started, depends on the prevailing conditions. In the exemplary embodiment shown, the upgrading module 50 has taken over all functions. Normally, the hydraulic pumps 66, 80 are started to maintain the necessary pressure for their respective second valve packs 61 and 82, whereas the chemical pump 92 may be controlled with respect to pressure or rate.

It may be added that the reservoir 96 may be divided in order to contain, for example, both a chemical and methanol. The methanol is supplied by means of a tube, not shown, in the umbilical 22, and the chemical pump 92 is provided with a change-over valve to be able to draw the desired chemical.

Valves required per se which are not necessary for the explanation of the invention, are not shown, as a person skilled in the art will know the purpose and operation thereof.

Thus, during operation, the second control module 62 has taken over at least the control functions of the control module 18, whereas the high-pressure tube of the umbilical 22 may work at a considerably reduced pressure.

Figure 3:
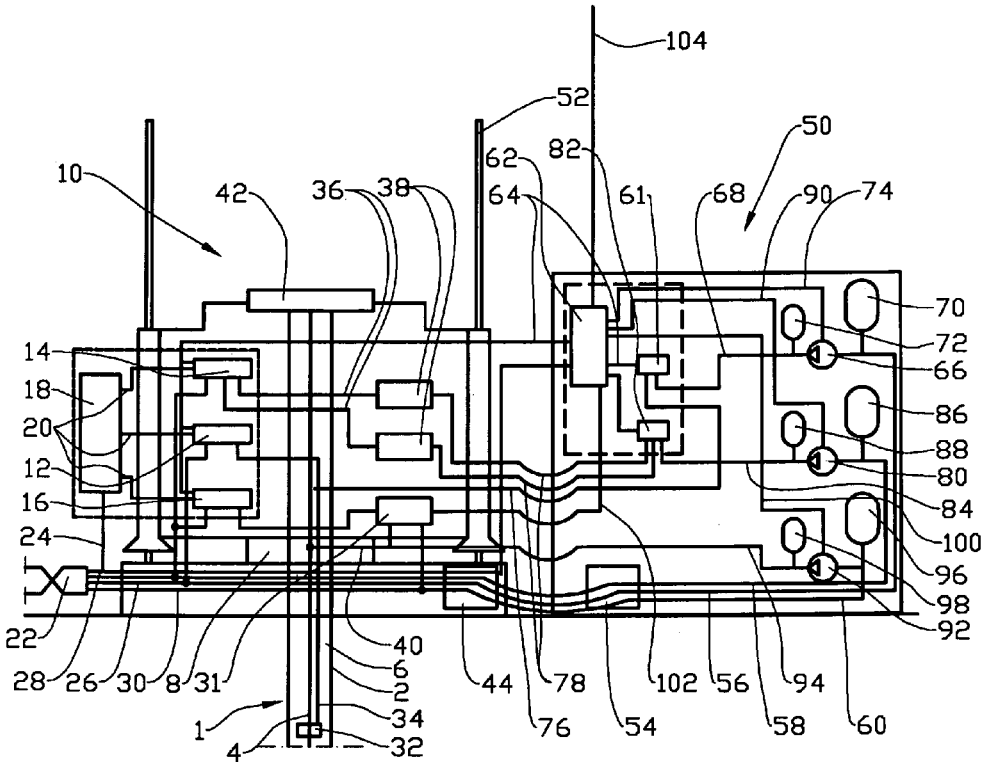
FIG. 3 shows schematically the same as FIG. 2, but in an alternative embodiment.

In an alternative exemplary embodiment, see FIG. 3, the umbilical 22 is so damaged that it cannot be used. Electrical power and control signals are supplied via a line 104 from a vessel not shown. Whenever necessary, the reservoirs 70, 86, 96 are replenished in a manner known per se.

The invention claimed is:

1. A method of extending the lifetime of a Christmas tree, the Christmas tree being provided with at least a first high-pressure hydraulic valve pack, a first low-pressure hydraulic valve pack or a first chemical valve pack, and the Christmas tree being arranged to be connectable to an umbilical which comprises at least electrical power or control cables, hydraulic tubes or chemical tubes, the method comprising:

retrofitting an upgrading module in association with the Christmas tree and connecting the upgrading module to the Christmas tree with the a number of tube and wire connections, the upgrading module comprising, a second control module, and at least a hydraulic high-pressure pump with a second high-pressure valve pack and a hydraulic reservoir, a hydraulic low-pressure pump with a second low-pressure hydraulic valve pack and a hydraulic reservoir or a chemical pump with a chemical reservoir;

supplying the second control module with electrical power and control signals via the umbilical or from a vessel; and supplying at least the high-pressure pump, the low-pressure pump or the chemical pump directly or indirectly via their respective reservoirs with hydraulic fluid via the umbilical or from a vessel, wherein the upgrading module is placed beside the Christmas tree.

2. An upgrading module to be retrofitted in association with a Christmas tree, the Christmas tree being provided with at least a first high-pressure hydraulic valve pack, a first low-pressure hydraulic valve pack or a first chemical valve pack, the Christmas tree being arranged to be connected to an umbilical which comprises at least electrical power and control cables, hydraulic tubes or chemical tubes, and the upgrading module being provided with a second electric control module which is connectable to at least the power and control cables of the umbilical or from a vessel, and the upgrading module comprising at least a hydraulic high-pressure pump with a second high-pressure valve pack and a hydraulic reservoir, a hydraulic low-pressure pump with a second low-pressure hydraulic valve pack and a hydraulic reservoir or a chemical pump with a chemical reservoir, the upgrading module being connectable to the Christmas tree, wherein the upgrading module is placed beside the Christmas tree.

3. The upgrading module in accordance with claim 2, wherein the hydraulic high-pressure pump is connectable, directly or indirectly via a reservoir, to at least the tubes of an umbilical or to a vessel and to at least a valve of a second high-pressure hydraulic valve pack and to the second control module.

4. The upgrading module in accordance with claim 2, wherein the hydraulic low-pressure pump is connectable, directly or indirectly via a reservoir, to at least the tubes of an umbilical or to a vessel and to at least a valve of a second low-pressure hydraulic valve pack and to the second control module.

5. The upgrading module in accordance with claim 2, wherein the chemical pump is connectable, directly or indirectly via a reservoir, to at least the tubes of an umbilical or to a vessel, and to at least a chemical valve or directly to a production tubing.

6. The upgrading module in accordance with claim 2, wherein the second control module is connected to a valve pack for chemical injection.

7. The upgrading module in accordance with claim 2, wherein the upgrading module is connected to the Christmas tree by means of ROV-activatable connections.

* * * * *